US010058830B2

(12) United States Patent
Somenzi et al.

(10) Patent No.: US 10,058,830 B2
(45) Date of Patent: Aug. 28, 2018

(54) STATION FOR STORING, COLLECTING AND RECIRCULATING A FLUID SUBSTANCE

(71) Applicants: Enrica Cinzia Maria Somenzi, Milan (IT); Emanuela Paci, Cassano Magnago (IT)

(72) Inventors: Enrica Cinzia Maria Somenzi, Milan (IT); Emanuela Paci, Cassano Magnago (IT)

( * ) Notice: Subject to any disclaimer, the term of this patent is extended or adjusted under 35 U.S.C. 154(b) by 290 days.

(21) Appl. No.: 14/786,240

(22) PCT Filed: Apr. 22, 2014

(86) PCT No.: PCT/IB2014/060889
§ 371 (c)(1),
(2) Date: Oct. 22, 2015

(87) PCT Pub. No.: WO2014/174428
PCT Pub. Date: Oct. 30, 2014

(65) Prior Publication Data

US 2016/0059193 A1 Mar. 3, 2016

(30) Foreign Application Priority Data

Apr. 22, 2013 (IT) ..... MI2013A0660

(51) Int. Cl.
*B01F 15/02* (2006.01)
*B01F 5/10* (2006.01)

(52) U.S. Cl.
CPC ..... *B01F 5/10* (2013.01); *B01F 15/0244* (2013.01)

(58) Field of Classification Search
CPC .. B01F 5/106; B01F 15/0244; B01F 15/0429; B01F 5/10; B01F 5/104; B01F 5/0061;
(Continued)

(56) References Cited

U.S. PATENT DOCUMENTS 3,814,003 A * 6/1974 Vacano ..... B01D 21/2472 99/276
4,427,298 A * 1/1984 Fahy ..... B01F 15/0429 137/624.18

(Continued)

FOREIGN PATENT DOCUMENTS

GB 1116656 6/1968
WO 00/74833 12/2000

OTHER PUBLICATIONS

International Search Report issued in PCT Application No. PCT/IB2014/060889.

*Primary Examiner* — Pranav N Patel
(74) *Attorney, Agent, or Firm* — Lucas & Mercanti, LLP

(57) ABSTRACT

Station (10) for internally and externally storing, collecting and recirculating a fluid substance, said station (10) comprising a tank (11) and a recirculation circuit (14) of the fluid substance contained in said tank (10). The circuit (14) is provided with a first end associated with a lower supply opening (12) and a second end associated with an upper loading opening (13); the circuit (14) being provided with a pump (15) and a first valve (16) associable with an external tank (17) through a loading conduit (18), the valve (16) being configurable for selectively defining the conditions of recirculation of the fluid substance contained in said tank (11) from the lower opening (12) to the upper opening (13) isolating said external tank (17), and loading the fluid substance from said external tank (17) to said tank (11) isolating the lower supply opening (12) of said tank (11). The recirculation circuit (14) comprises a second valve (19) being configurable for selectively defining the conditions of advancement of the fluid substance coming from the first valve (16) along the recirculation circuit (14) towards the upper opening (13) and diverting the fluid substance coming
(Continued)

from the first valve (16) of the recirculation circuit (14) towards the external tank (17) through a return duct (20).

10 Claims, 3 Drawing Sheets

(58) Field of Classification Search
CPC ..... B01F 5/0057; B01F 15/0243; B01F 15/0258; B01F 15/026; B01F 15/0251; B01F 2215/0014; B01F 2215/0031; B01F 2215/0032; B01F 3/12
See application file for complete search history.

(56) References Cited

U.S. PATENT DOCUMENTS

| | | | | |
|---|---|---|---|---|
| 4,857,355 | A | 8/1989 | Gregg | |
| 5,688,076 | A * | 11/1997 | Atkins | B01D 17/0205 166/267 |
| 2003/0178355 | A1* | 9/2003 | Beach | B01D 61/10 210/232 |
| 2008/0049544 | A1* | 2/2008 | Bingham | B01F 3/0446 366/101 |
| 2009/0242472 | A1* | 10/2009 | Wallerstorfer | A47J 31/605 210/232 |
| 2009/0316518 | A1* | 12/2009 | Goldsmith | B01F 3/12 366/134 |
| 2011/0203699 | A1* | 8/2011 | Rodgers | B01F 3/12 141/1 |

* cited by examiner 10
11
12
13
14
15
16
17
18
19
20
23
24

STATION FOR STORING, COLLECTING AND RECIRCULATING A FLUID SUBSTANCE

CROSS-REFERENCE TO RELATED APPLICATIONS

This application is a 371 of PCT/IB2014/060889, filed Apr. 22, 2014, which claims the benefit of Italian Patent Application No. MI2013A000660, filed Apr. 22, 2013.

FIELD OF THE INVENTION

The present invention refers to an autonomous station for storing, collecting and recirculating a fluid substance, where the expression fluid substance also refers to liquid and/or pasty substances, as well as solid substances, susceptible of precipitating or being aggregated, such as for example dyes in liquid or solid dispersion.

BACKGROUND OF THE INVENTION

As shown in FIGS. 1 and 2, stations for storing, collecting and recirculating a fluid substance are currently known, which comprise:

- a tank 11' for storing the substance provided with a lower supply opening 12' and an upper loading opening 13'; and
- a circuit 14' for recirculating the fluid substance contained in the tank 11.

In particular, such recirculation circuit 14' is provided with a first end associated with the lower supply opening 12, either directly or through a supply duct 24', and a second end associated with the upper loading opening 13.

Between the first and the second end of the recirculation circuit 14' a pump 15' and an assembly of manual valves 16' are provided.

The valve 16' is associable with an external tank 17' through a loading conduit 18' and it is configurable for selectively defining the conditions of:

- recirculation (FIG. 1) of the fluid substance contained in the tank 11' along the recirculation circuit 14' from the lower supply opening 12' to the upper loading opening 13' isolating the external tank 17'; and
- loading (FIG. 2) the fluid substance from the external tank 17' to the tank 11' isolating the lower supply opening 12' of the tank 11'.

In other words, in the condition of loading, the valve 16' closes the part upstream of the circuit 14'.

However, given that the substance stored in the external tank 17' usually remains stationary for a long time before being loaded into the tank 11', such external tank 17' usually coming from very distant places with respect to the stations, the use of mechanical agitators to be previously inserted in the external tank 17' before extracting the fluid substance therefrom is currently provided.

As evincible, this is for guaranteeing, right from the start inside the tank 11', an acceptable degree of homogeneity of the product which can thus be supplied without delay and slowing down.

However, such procedure currently in use reveals some drawbacks, such as the required presence of several mechanical agitators so as not to waste time in loading one tank 11 at a time.

Such agitators must then either be stored, wasting space, or sent again along with the tank thus increasing shipment costs.

SUMMARY OF THE INVENTION

Starting from said prior art, the object of the present invention is to provide a station for storing, collecting and recirculating a fluid substance that is an alternative to the known ones, particularly efficient and capable of making the substance stored in the external tanks homogeneous without requiring mechanical agitators or, generally, any other appliance besides the station itself.

Thus, an object of the present invention is to obtain the loading of a homogeneous substance in the tank from the external tank, in absence of mechanical members outside the station.

Generally, the present invention proposes the solution of providing a second valve arranged downstream of the first valve along the flow of the substance in the recirculation circuit configurable for selectively defining the conditions of:

- advancement of the fluid substance along the recirculation circuit, so as to guarantee the correct loading (FIG. 5) and recirculation (FIG. 6) of the substance coming from the first valve;
- diverting the fluid substance from the recirculation circuit (FIG. 4) towards the external tank through a return duct.

In particular, such second configuration allows to obtain, with the first valve configured correctly to isolate the section upstream of the recirculation circuit, a closed circuit for recirculating the substance contained in the external tank.

Thus, through such invention, upon obtaining the external tank and without the presence of mechanical agitators, it is sufficient to connect the external tank to the two valves which, if configured correctly like in FIG. 4 and as described above, make a circuit for recirculating the substance contained in the external tank making it homogeneous and ready to be loaded into the tank.

Upon completing such preliminary step, see FIG. 5, it is sufficient to actuate the second valve to control the diversion of the homogeneous flow towards the tank. Upon completing loading, see FIG. 6, for the periodic mixing of the substance contained in the tank it is sufficient to operate on the first valve to obtain the classic recirculation of the substance contained in the tank.

In other words, the station of the present invention allows to obtain two recirculation circuits besides the classic loading circuit from an external tank. A classic "internal" circuit for recirculating the substance contained in the tank, FIG. 6, and an "external" circuit for recirculating the substance contained in the external tank.

Further characteristics of the invention shall be more apparent from the dependent claims and in the description of the preferred embodiment.

BRIEF DESCRIPTION OF THE DRAWINGS

The characteristics and advantages of an internal and external autonomous station for storing, collecting and recirculating a fluid substance according to the present invention shall be more apparent from the following exemplifying and non-limiting description with reference to the attached schematic drawings wherein.

DETAILED DESCRIPTION OF THE INVENTION

Figure 1:
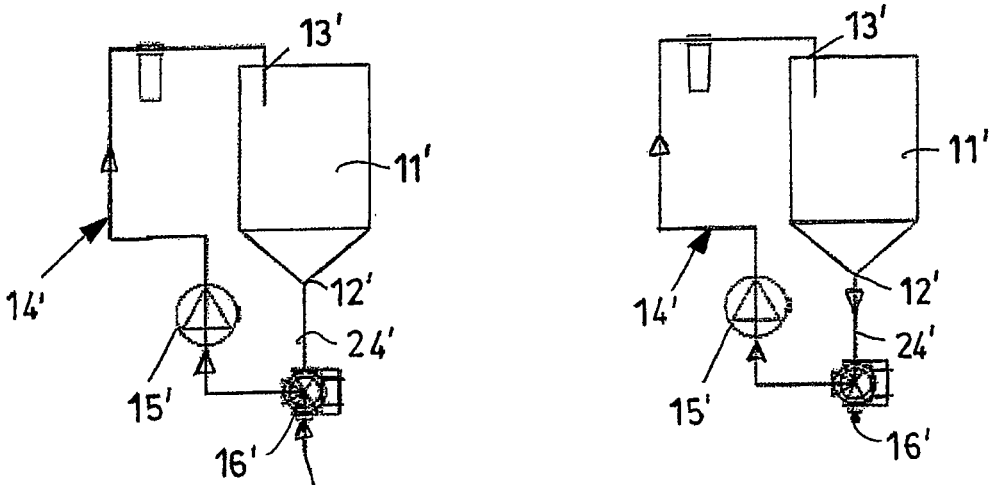
Fig.1 PRIOR ART
FIGS. 1 and 2 are examples of stations according to the prior art.
Figure 2:
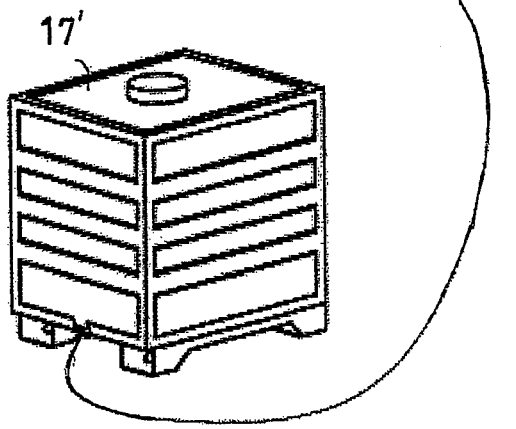
Fig.2 PRIOR ART
Figure 3:
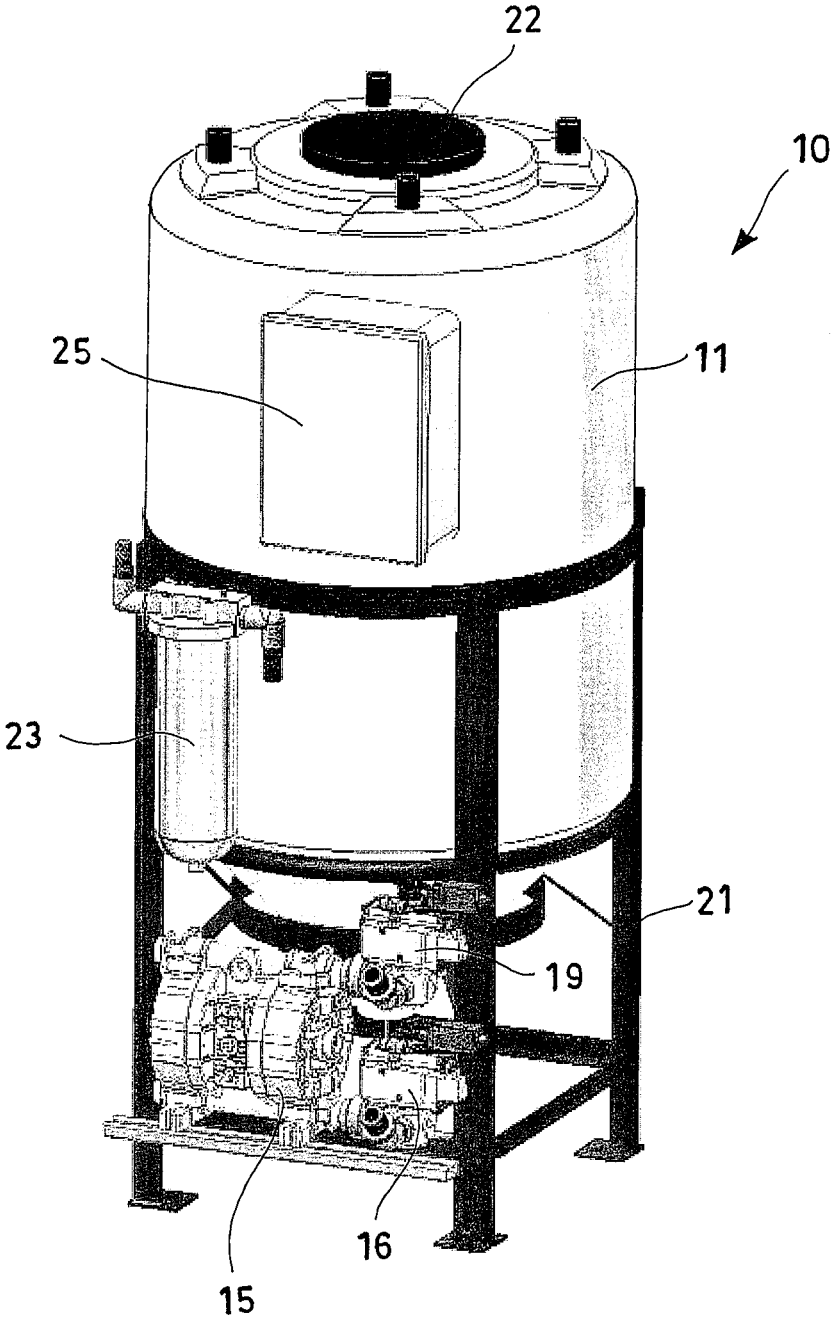
FIGS. 3-6 are an example of embodiment of a station of the present invention respectively in "external" recirculation, loading and "internal" recirculation configurations.

With reference to the FIGS. 3-6, a station for storing, collecting and recirculating a fluid substance according to the present invention is shown with 10. Like the analogous known stations, station 10 of the present invention also comprises a tank 11, provided with a lower supply opening 12 and an upper loading opening 13, and a recirculation circuit 14 of the fluid substance contained in the tank 10.

As known, such recirculation circuit 14 is provided with a first end associated with the lower supply opening 12 and a second end associated with the upper loading opening 13.

Between the first and the second end of the recirculation circuit 14 a pump 15, for example a double membrane pump with pneumatic activation, and a first valve 16 associated with the lower supply opening 12, either directly or through a supply duct 24' are provided.

Preferably, following the flow of the fluid substance from the lower supply opening 12 to the upper loading opening 13, the pump 15 is arranged downstream of the valve 16.

Such valve 16 is associable with an external tank 17 through a loading conduit 18 and it is configurable for selectively defining the conditions of:

- recirculation of the fluid substance contained in the tank 11 through circulation in the recirculation circuit 14 from the lower supply opening 12 to the upper loading opening 13 isolating the external tank 17; and
- loading the fluid substance from the external tank 17 to the tank 11 thus making the fluid substance to pass in the loading conduit 18 and, once the valve 16 has been passed, in the recirculation circuit 14 up to the upper loading opening 13.

Figures 4, 5, 6:
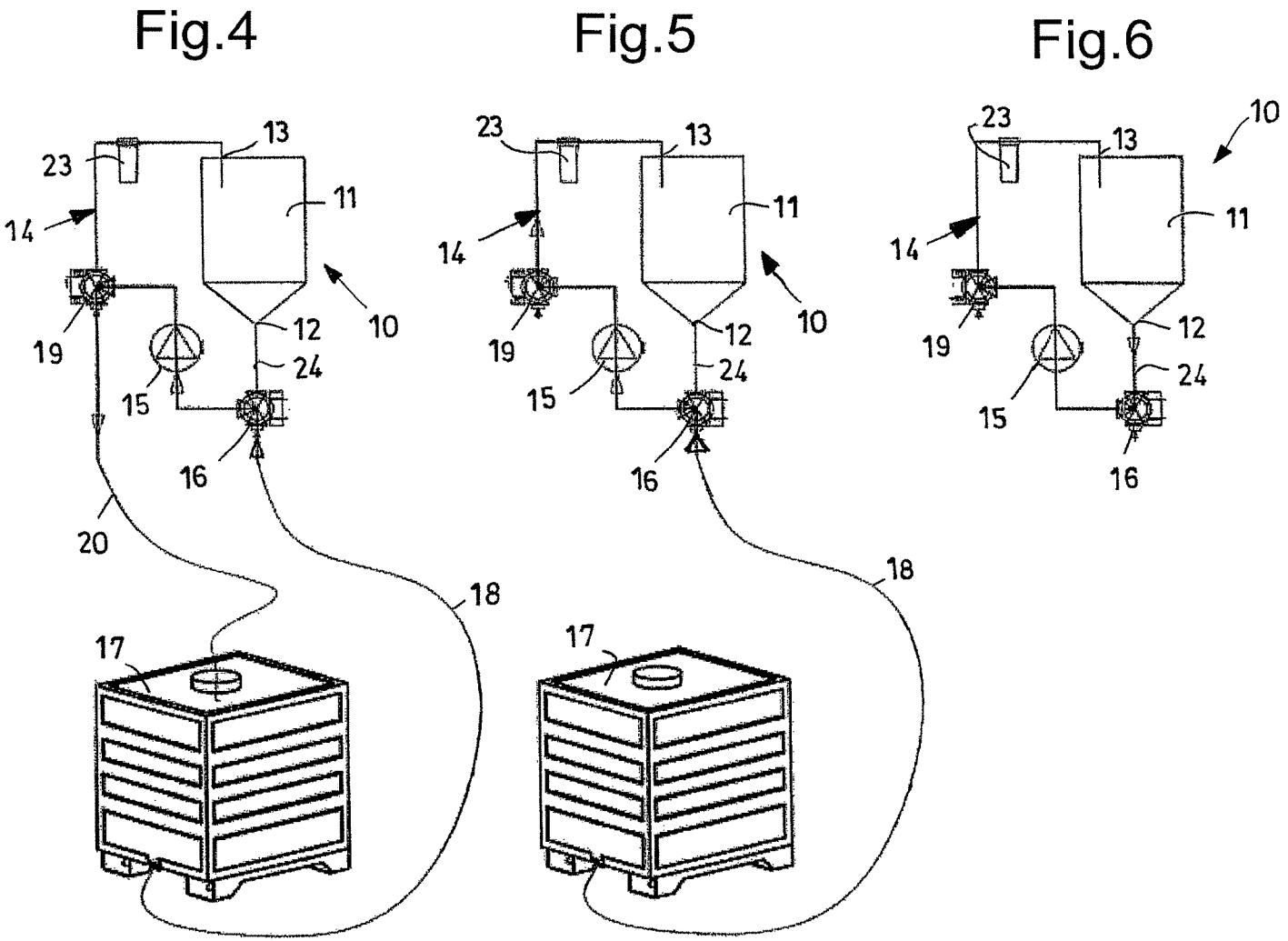

The recirculation condition is shown in FIG. 6 and the loading condition in FIG. 5.

According to the invention, the recirculation circuit 14 further comprises a second valve 19, preferably downstream of the pump 15, where the second valve 19 is associable with the external tank 17 through a return duct 20.

Such second valve 19 is configurable for selectively defining the conditions of:

- advancement of the fluid substance coming from the first valve 16 along said recirculation circuit 14 towards the upper loading opening 13;
- diverting the fluid substance coming from the first valve 16 from the recirculation circuit 14 towards the external tank 17 through the return duct 20.

Thus, the present invention generally provides for a second valve 19 integrated in the recirculation circuit 14 arranged downstream of the pump 15 and the first valve 16 configurable for selectively defining the conditions of:

- advancement of the fluid substance along the recirculation circuit to guarantee the correct loading (FIG. 5) and recirculation (FIG. 6) of the substance contained in the tank;
- diverting the fluid substance from the recirculation circuit (FIG. 4) towards the external tank through a return duct 20.

In particular, such second configuration allows to obtain, with the first valve configured correctly to isolate the tank 11 and load the fluid substance from the external tank 17 through the loading conduit 18 and with the second valve 19 configured correctly to divert the flow towards the external tank 17 through the return duct 20, a closed circuit for recirculating the substance contained in the external tank defined by the external tank 17, the conduits 18 and 29 and the section of the recirculation circuit 14 between the valves 16 and 19.

Thus, such invention, upon obtaining the external tank 17 and without the presence of mechanical agitators, it is sufficient to simply connect the external tank 17 to the two valves 16, 19, for example through quick couplings, which, if configured correctly like in FIG. 4 and like described above, form a circuit for recirculating the substance contained in the external tank 17 making it homogeneous before being loaded into the tank. It shall thus be immediately suitable for being supplied upon loading.

Upon completing such "external" recirculation step, i.e. isolating the tank 11, it is sufficient to actuate the second valve 19 to divert the flow towards the upper opening 13 to fill the tank 11 with the homogeneous substance.

Such step is shown in FIG. 5.

Upon completing loading to obtain a periodic mixing of the substance contained in the tank 11, it is sufficient to act on the first valve 16 to isolate the external tank 17 and make the substance contained in the tank 11 exiting from the lower opening 12 circulate in the recirculation circuit 14.

Such step is shown in FIG. 6.

The invention is completed by a series of solutions which serve to what has been outlined above, i.e. the presence of a supporting structure 21 of the raised tank 11, an inspection hatch 22 of the tank, a cartridge filtration system inside the tank 10 and a metering valve 23 along the circuit 14.

Given that the station is entirely autonomous or, as referred to in the industry, is a standalone machine, a control unit 25, as well as a plurality of controls directly integrated in the machine is provided.

Such control unit 25 controls the valves 16, 19 and the pump 15, controls the clogging level of the filter and it can preferably be connected to at least one level sensor arranged in the tank.

The control unit 25 controls, for example, the valves 16, 19 monitoring the end stroke thereof for verifying whether they are "turned" correctly.

Analogously the control of the flexible pipes 18, 20, that are inserted correctly on the couplings of the valves may also be provided.

Lastly, a control of a barcode printed on a label arranged on the external container may be provided to verify whether the product to be loaded and/or recycled is the correct one.

It has thus been observed that a station for storing, collecting and recirculating a fluid substance according to the present invention attains the objects outlined above.

The station for storing, collecting and recirculating a fluid substance of the present invention thus conceived can be subjected to many modifications and variants, all falling within the same inventive concept; furthermore, all details can be replaced by technically equivalent elements. In practice, the materials used, as well as their dimensions, may vary according to the technical requirements.

The invention claimed is:

1. A storage, collection and internal and external recirculation station of a fluid substance, said station comprising:

- a tank equipped with a lower supply opening and an upper loading opening and connected to an internal recirculation circuit for recirculating the fluid substance contained in said tank; said internal recirculation circuit being equipped with a first end coupled to said lower supply opening and a second end coupled to said upper loading opening; between said first and second end of said recirculation circuit, there being provided a pump, a first valve, and a second valve;

wherein said pump is positioned between and connected to said first valve and said second valve;

wherein said first valve is coupled to a bottom of an external tank through a loading duct, said external tank being configured to store the fluid substance to be made homogeneous;

wherein said second valve is coupled to a top of said external tank through a return duct thereby forming a closed, external recirculation circuit between said first valve, said pump, said second valve, and said external tank;

wherein said closed, external recirculation circuit is configured to homogenize the fluid substance contained in the external tank by deviating the fluid substance coming from said first valve to said external tank by said second valve thereby bypassing said internal recirculation circuit back to said tank;

wherein said first valve is configured to:

direct the fluid substance contained in said tank through said internal recirculation circuit from said lower supply opening to said upper loading opening of said tank thereby isolating and bypassing said external tank; and direct the fluid substance from said external tank to said tank thereby isolating and bypassing the lower supply opening of said tank;

wherein said second valve is configured to:

direct the fluid substance coming from said first valve along said internal recirculation circuit towards said upper loading opening to charge said tank; and direct the fluid substance coming from said first valve in said external recirculation circuit towards said external tank through said return duct thereby isolating and bypassing said tank.

2. The station according to claim 1, further comprising a supporting structure of said tank.

3. The station according to claim 1, wherein said tank is equipped with an inspection hatch.

4. The station according to claim 1, wherein said pump is a double membrane pump with pneumatic activation.

5. The station according to claim 1, further comprising a cartridge filtration system inside said tank.

6. The station according to claim 1, wherein said valves are equipped with rapid couplings to said ducts.

7. The station according to claim 1, further comprising a metering valve along said circuit.

8. The station according to claim 1, further comprising a control unit of said valves.

9. The station according to claim 8, further comprising at least one level sensor arranged inside said tank connected to said control unit.

10. The station according to claim 1, wherein the external tank omits mechanical agitators.

* * * * *